US006974937B2

(12) United States Patent
Kim

(10) Patent No.: US 6,974,937 B2
(45) Date of Patent: Dec. 13, 2005

(54) APPARATUS AND METHOD FOR EXHAUSTING POLLUTANT IN MICROWAVE OVEN

(75) Inventor: Seog Tae Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/816,824

(22) Filed: Apr. 5, 2004

(65) Prior Publication Data

US 2005/0011887 A1 Jan. 20, 2005

(30) Foreign Application Priority Data

Jul. 16, 2003 (KR) ..... 10-2003-0048918

(51) Int. Cl.[7] ..... H05B 6/68

(52) U.S. Cl. ..... 219/757; 219/702; 219/707; 126/299 R; 126/299 D

(58) Field of Search ..... 219/702, 757, 219/707; 126/21 A, 299 R; 129/299 D

(56) References Cited

U.S. PATENT DOCUMENTS

| | | | | |
|---|---|---|---|---|
| 5,074,281 | A * | 12/1991 | Fluhrer et al. | 126/299 D |
| 6,104,016 | A * | 8/2000 | Lee | 219/702 |
| 6,142,142 | A * | 11/2000 | Woodall et al. | 126/299 R |
| 6,170,480 | B1 * | 1/2001 | Melink et al. | 126/299 R |
| 6,484,713 | B1 * | 11/2002 | Schmitt et al. | 126/299 R |
| 6,578,569 | B2 * | 6/2003 | Liese | 126/299 R |

* cited by examiner

*Primary Examiner*—Philip H. Leung
(74) *Attorney, Agent, or Firm*—Birch, Stewart, Kolasch & Birch, LLP

(57) ABSTRACT

Disclosed is an apparatus for exhausting pollutant for a microwave oven, the apparatus comprising: a sensor part formed at a predetermined portion of the microwave oven, for detecting fumes and/or moisture contained in polluted air generated during a cooking process; a controller for determining whether or not amount of the fumes and/or moisture detected by the sensor part is greater than a predetermined reference value; and a fan driving part operated, when the amount detected by the controller is greater than the reference value, by a driving signal from the controller and allowing air containing the pollutant to be inhaled and then removed from an interior.

17 Claims, 5 Drawing Sheets

APPARATUS AND METHOD FOR EXHAUSTING POLLUTANT IN MICROWAVE OVEN

This Nonprovisional application claims priority under 35 U.S.C. § 119(a) on Patent Application No(s). 10-2003-0048918 filed in Korea on Jul. 16, 2003, the entire contents of which are hereby incorporated by reference.

BACKGROUND OF THE INVENTION

1. Field of the Invention

The present invention relates to a microwave oven, and more particularly, to an apparatus and method for exhausting pollutant in a microwave oven that can improve not only the kitchen environment but also the overall interior environment by quickly exhausting polluted air containing, for example, fumes, moisture, and odor that are generated during cooking process to thereby worsen the kitchen environment.

2. Description of the Related Art

A microwave oven is a sort of cooking apparatus having a magnetron for generating and directing a microwave to food loaded in a cooking cavity of the microwave oven to lead to the molecular movement generating heat for the food.

Particularly, in recent years, an over-the-range (OTR) type microwave oven that is placed over a main cooking device such as a gas oven range has been developed. The OTR type microwave has a function of the cooker itself as well as a function of ventilator that removes fumes and/or moisture generated in the main cooking device during the cooking process. Such an OTR type microwave oven is already well known through publications disclosed by the applicant. (assignee) of the present invention.

FIG. 1 shows a view illustrating a combination of a conventional OTR type microwave oven and a main cooking device, and FIG. 2 shows a view illustrating a discharging process of polluted air out of a conventional OTR type microwave oven.

Referring to FIGS. 1 and 2, there is shown a main cooking device 10 exampled as a gas oven range and a microwave oven 20 for exhausting polluted air containing fumes and/or moisture generated by the cooking device 10.

The microwave oven 20 includes a cover 21 defining an outer appearance of the microwave oven 20, an intake duct part 23 serving as an intake passage through which the polluted air exhausted from the main cooking device 10 is inhaled into the microwave oven, a blower fan 24 for forming a forced-flow of the polluted air received through the intake duct part 23, a discharge duct part 26 for directing the polluted air exhausted through the blower fan 24 to an interior, a filter 25 disposed in the discharge duct part 26, a grill 27 disposed at an end of the discharge duct part 26, for exhausting air to an exterior, and a door 28 formed on a front side of the cover 21.

The microwave oven 20 is further provided at an inside thereof with a cooking cavity (not shown) where food is placed.

In addition, in order to quickly exhaust the fume generated during the cooking process to the exterior, the microwave oven 20 is further provided with an exhaust hole 30 formed opened at a rear side of the blower fan 24 and a through hole formed in a wall and aligned with the exhaust hole 30.

The operation of the above-described conventional microwave oven will be described hereinafter.

Polluted air containing fumes and/or moisture may be generated in the course of the cooking process. The polluted air is inhaled to the microwave oven 20 through the intake duct part 23 by the blower fan 24, and is then exhausted to the exterior through the exhaust hole 30 and the through hole 36.

In case where it is difficult to exhaust the polluted air to the exterior or the polluted degree of the air is low, the polluted air exhausted from the blower fan 24 is discharged through the discharge duct part 26. While the polluted air is discharged, it is filtered by the filter 25 so that only the purified air is introduced into the interior.

The selection of one of the exhaust functions for discharging the fumes to the exterior through the exhaust and through holes 30 and 36 and to the interior through the discharge duct part 26 can be realized by a selection switch.

Meanwhile, the air intake operation by the rotation of blower fan 24 can be initiated manually by a user or initiated automatically by a temperature sensor 31 formed on the microwave oven 20.

The manual initiating operation for the blower fan 24 is troublesome for the user.

When the temperature sensor 31 is used, the operation reliability may be deteriorated. That is, since a temperature of the polluted air generated in the main cooking device 10 is not generally so high enough to be detected by the sensor, the blower fan 24 may not be operated even when a large amount of fumes is generated.

SUMMARY OF THE INVENTION

Accordingly, the present invention is directed to apparatus and method for exhausting pollutant in a microwave oven that substantially obviate one or more problems due to limitations and disadvantages of the related art.

An object of the present invention is to provide an apparatus and method for exhausting pollutant in a microwave oven that can quickly exhaust polluted air containing fumes and/or moisture that is generated during cooking process to an exterior.

Another object of the present invention is to provide an apparatus and method for exhausting pollutant in a microwave oven that can improve the operational reliability of a blower fan of the microwave oven.

Still another object of the present invention is to provide an apparatus and method for exhausting pollutant in a microwave oven that can improve the overall interior environment by quickly exhausting polluted air generated during cooking process to an exterior or by purifying the polluted air.

Additional advantages, objects, and features of the invention will be set forth in part in the description -which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an apparatus for exhausting pollutant in a microwave oven, the apparatus comprising: a sensor part formed at a predetermined portion of the microwave oven, for detecting fumes and/or moisture contained in polluted air generated during a cooking process; a controller for determining whether or not amount of the fumes and/or moisture detected by the sensor part is greater than a predetermined reference value; and a fan driving part operated, when the amount detected by the controller is greater than the reference value, by a driving signal from the controller and allowing air containing the pollutant to be inhaled and then removed from an interior.

In an aspect of the present invention, there is provided a method for exhausting pollutant in a microwave oven, the method comprising the steps of: if foods are cooked and fumes and/or moisture are generated, detecting the fumes and/or moisture at a detecting sensor of the microwave oven; and comparing amount of the detected fumes and/or moisture with a first reference value to operate a blower fan when the amount is greater than the first reference value and not to operate the blower fan when the amount is equal to or less than the first reference value, and continuing to performing the detecting step.

In another aspect of the present invention, there is provided a method for exhausting pollutant in a microwave oven, the method comprising the steps of: comparing an amount of fumes and/or moisture contained in the pollutant generated during a cooking process with a first reference value; operating a blower fan when the amount is greater than the first reference value; purifying the pollutant; and stopping the operation of the blower fan when the amount of the pollutant detected after the purifying step, is less than a second reference value.

In a further aspect of the present invention, there is provided an apparatus for exhausting pollutant in a microwave oven, the apparatus comprising: a detecting sensor formed at a predetermined position of the microwave oven, for detecting fumes and/or moisture contained in pollutant; a blower fan operated in accordance with a control signal from the detecting sensor; and an exhaust hole through which the air inhaled/discharged by the blower fan is discharged to an exterior and/or a discharge duct part through which the air inhaled/discharged by the blower fan is discharged to an interior.

According to the present invention, the polluted air generated during the cooking process can be quickly exhausted.

In addition, since the sensor is designed to detect the fumes and/or moisture rather than a temperature, the operational reliability of the blower fan can be more improved. That is, the blower fan can be operated timely, thereby improving the interior environment.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
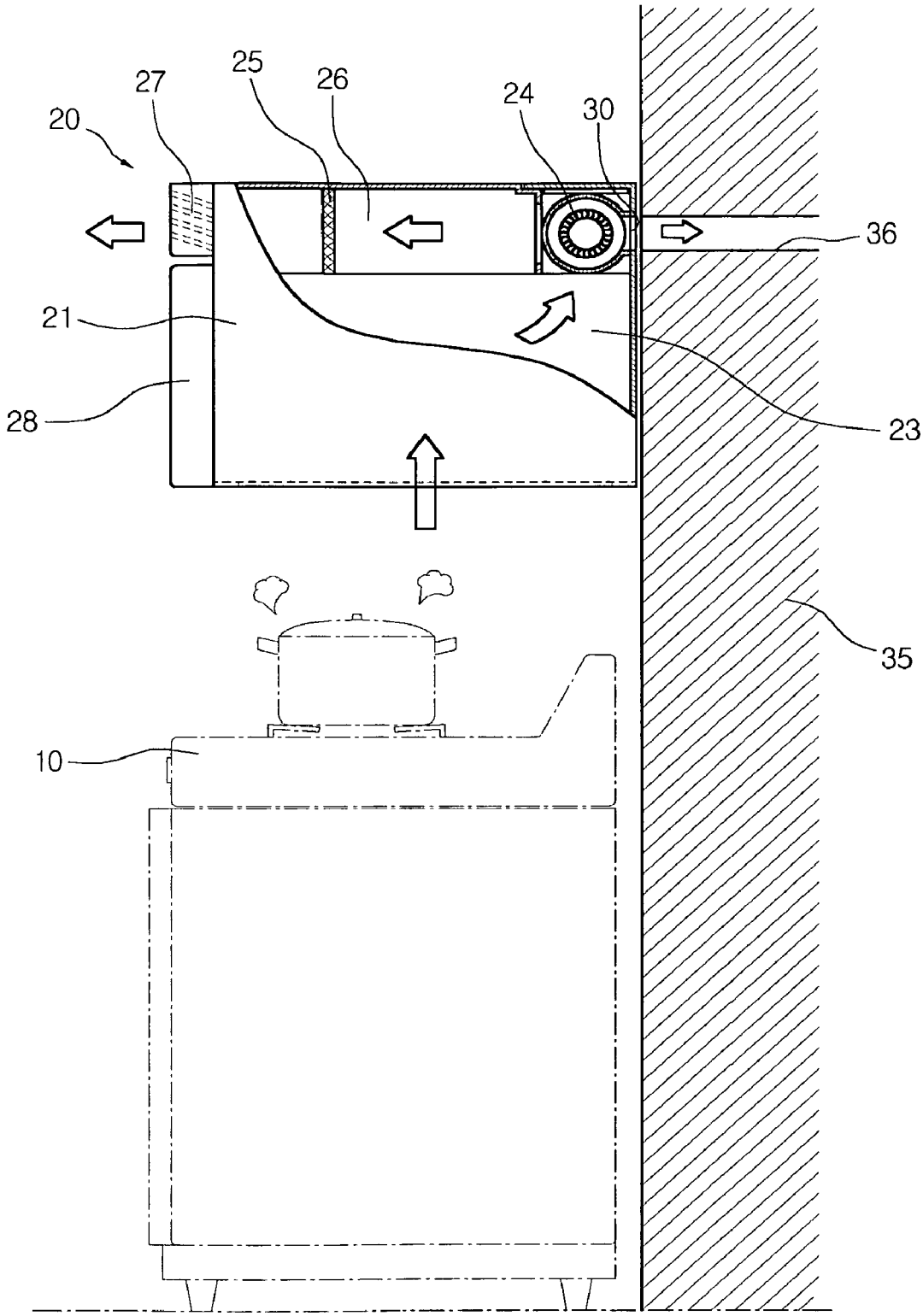
Fig. 1 (Conventional Art)
FIG. 1 is a view illustrating a combination of a conventional OTR type microwave oven and a main cooking device.
Figure 2:
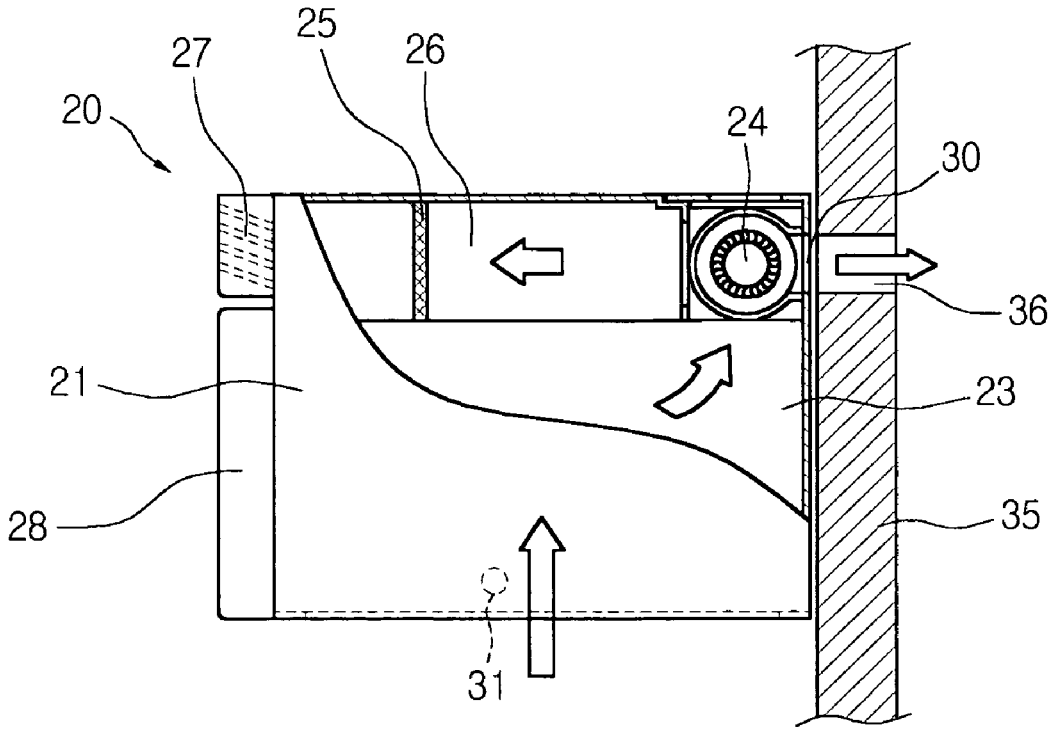
Fig. 2 (Conventional Art)
FIG. 2 is a partial sectional view of a conventional OTR type microwave oven exhausting air to an interior.
Figure 3:
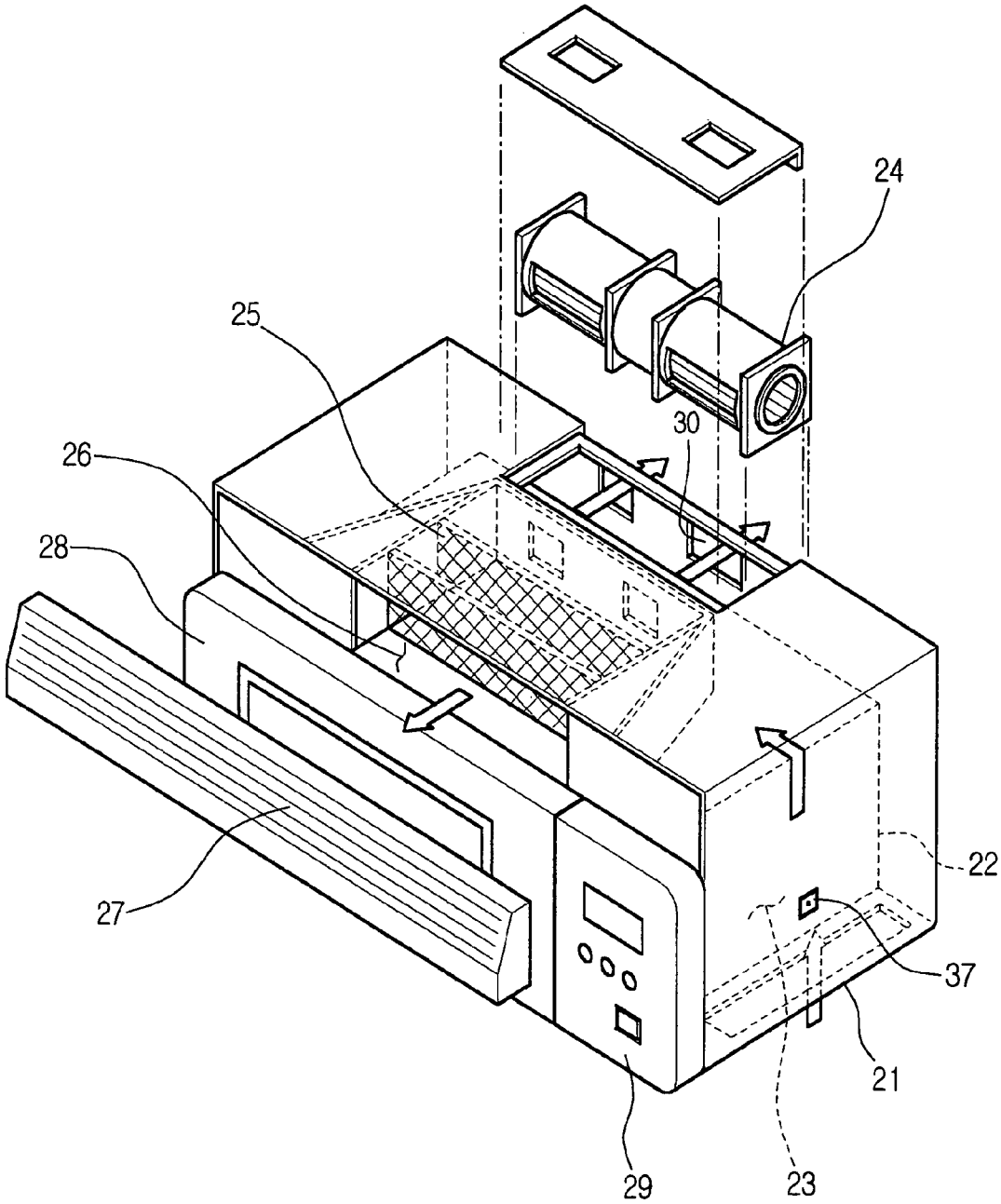
FIG. 3 is an exploded perspective view of a microwave oven where a polluted air exhausting apparatus according to the present invention is employed.

FIG. 3 is an exploded perspective view of a microwave oven where a polluted air exhausting apparatus according to the present invention is employed.

Referring to FIG. 3, a microwave oven having the inventive polluted air exhaust apparatus includes a cover 21 defining an outer appearance of the microwave oven, an inner case 22 disposed in the cover 21, an intake duct part 23 defined between the inner case 23 and the cover 21, a blower fan 24 for generating suction force directing polluted air into the intake duct part 23, a discharge duct part 26 for discharging the polluted air exhausted through the blower fan 24 to an interior, exhaust holes 30 formed on the cover 21 to discharge the polluted air exhausted through the blower fan 24 to an exterior, a filter 25 disposed in the discharge duct part 26 to filter polluted matters such as fumes and/or moisture from the polluted air, and a detecting sensor 37 for detecting fume or moisture contained in the air inhaled through the intake duct part 23.

The microwave oven further includes a grill 27 formed on a frontward downstream end of the discharge duct part 26 and a front door 28 formed under the grill to load and unload food in and from a cooking cavity.

The microwave oven 20 further comprises a control panel 29 formed on the front side of the microwave oven for controlling the operation of the microwave oven.

The detecting sensor 37 is not for detecting a temperature but for detecting fumes and/or moisture contained in the polluted air generated during the cooking process. Therefore, a fume detecting sensor and/or a moisture detecting sensor may be used as the detecting sensor.

In the drawing, the detecting sensor 37 is located in the intake duct part 23. However, the location of the detecting sensor 37 is not limited to this. Any places where the detecting sensor 37 can detect the fume and/or moisture will be acceptable. For example, a bottom or other outer surfaces can be selected for disposing the detecting sensor.

The polluted air exhausted through the blower fan 24 can be discharged through either the discharge duct part 26 or the exhaust holes 30. In order to optionally switch the discharge direction between the exhaust holes 30 and the discharge duct part 26, a predetermined selection switch may be further provided. However, when only one of the discharge duct part 26 for discharging the air into the interior and the exhaust hole 30 for discharging the air into the exterior is employed to the microwave oven, such a selection switch is not required.

The operation of the microwave oven according to the present invention will be described hereinafter.

Fumes and/or moisture contained in the polluted air generated during the cooking process in the main cooking device placed below the microwave oven is first detected by the detecting sensor 37.

When the detecting sensor 37 detects the fumes and/or moisture, the corresponding signal is transmitted to a controller of the microwave oven to operate the blower fan 24.

When the blower fan 24 is operated, the polluted air containing the fumes and/or moisture is directed to the intake duct part 23, and is then exhausted through the blower fan 24. The polluted air exhausted through the blower fan 24 is discharged through one of the exhaust holes 30 or the discharge duct part 26.

When the amount of the fumes and/or moisture contained in the polluted air is high, the polluted air is exhausted to the exterior through the exhaust holes 30. When the amount of the fumes and/or moisture is not so high or the exhaust holes to the exterior are not formed, the polluted air is purified by the filter in the discharge duct part 26, and is then discharged to the interior through the discharge duct part 26.

As described above, since detecting sensor 37 is designed to detect the fumes and/or moisture, the operational reliability of the microwave oven in response to the fumes and/or moisture that are inevitably generated during the cooking process can be more improved.

Figure 4:
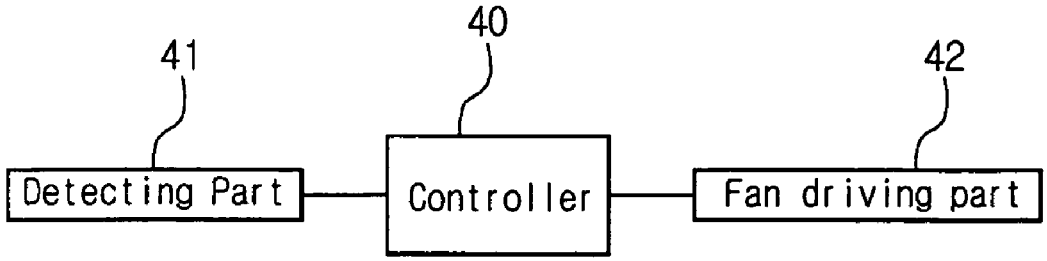
FIG. 4 is a block diagram of a polluted air exhausting apparatus for a microwave oven according to the present invention.

FIG. 4 shows a block diagram illustrating a polluted air exhausting apparatus for a microwave oven according to the present invention.

Referring to FIG. 4, the inventive air exhausting apparatus includes a detecting part 41 provided with at least a detecting sensor for detecting fumes and/or moisture contained in polluted air generated during the cooking process, a controller 42 for receiving a detecting signal converted from an amount of the fumes/moisture detected by the detecting sensor, and a fan driving part 43 operated by a driving signal from the controller 42 when the amount of the fumes/moisture is greater than a predetermined level and thereby it is required to quickly exhaust or purify the polluted air containing the fumes and/or moisture.

The detecting part 41 is the detecting sensor (see reference numeral 37 of FIG. 3), and may be at least one of a fume detecting sensor and a moisture detecting sensor. In addition, the controller 42 may comprise a microprocessor that is a part of the control panel (see reference numeral 24 in FIG. 3). The fan driving part 43 may comprise a motor for driving the blower fan (see reference numeral 24 in FIG. 3).

That is, when the detecting part 41 detects the fumes and/or moisture contained in the polluted air generated during the cooking process, the detected signal is transmitted to the controller 42. The controller 42 compares the detected signal with a predetermined reference value to determine if there is a need for quickly exhausting or purifying the polluted air containing the fumes and/or moisture. When it is determined that there is a need for quickly exhausting or purifying the air, the controller 42 transmits a driving signal to the fan driving part 43 to operate the blower fan, thereby quickly exhausting or purifying the air.

A polluted air exhausting method for the microwave oven according to the present invention will be described more in detail with reference to FIG. 5.

Figure 5:
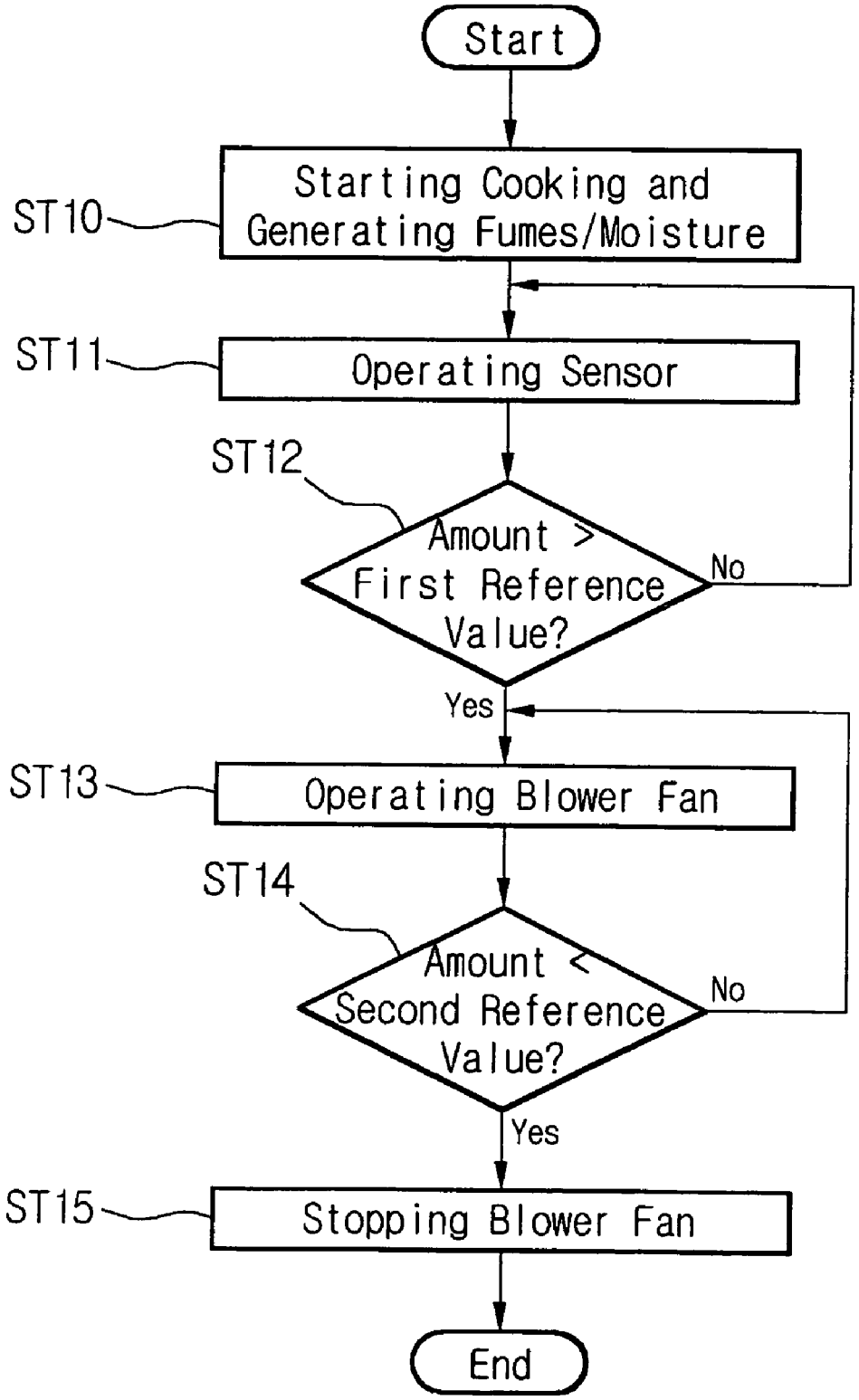
FIG. 5 is a flowchart illustrating a polluted air exhausting method for a microwave oven according to the present invention.

FIG. 5 shows a flowchart illustrating the polluted air exhausting method.

As shown in the flowchart, when the cooking is processed in the main cooking device disposed adjacent (i.e., below) the microwave oven and thereby polluted air containing fumes and/or moisture is generated (ST10), the fumes and/or moisture contained the polluted air is detected by the detecting sensor provided on the microwave oven (ST11).

An amount of the fumes and/or moisture detected by the detecting sensor is compared with a first reference value (ST12). When the amount is equal to or less than the first reference value, the blower fan is not operated and the sensor keeps operating. When the amount is greater than the first reference value, the blower fan is operated to quickly exhaust the polluted air containing the fumes and/or moisture to the exterior or to purify the same using a filter (ST13).

At this point, the detecting sensor still keeps operating to continuously detect fumes and/or moisture. Therefore, when an amount of current fumes and/or moisture is less than a second reference value, it is determined that all of fumes and/or moisture is exhausted, thereby stopping the operation of the blower fan (ST15). However, when the amount of the current fumes and/or moisture is equal to or greater than the second reference value, the blower fan is continuously operated (ST13) so that the air containing the fumes and/or moisture can be exhausted (ST14).

Meanwhile, the first and second reference values may be set to be identical to each other. However, the first reference value is set as a standard value for determining an amount of the fumes and/or moisture generated at an initial cooking process, and the second reference value is set as a standard value for determining an amount of the fumes and/or moisture generated after the cooking process is finished (and then exhausting of a polluted air is completed to some extent). Particularly, the second reference value is set to an extent that can maintain a clean interior environment to a predetermined level.

Accordingly, the second reference value is generally set to detect a low amount of the fumes and/or moisture when compared with the first reference value. That is, since the first reference value is set as a standard value for determining a high amount of the fumes and/or moisture, a malfunction of the microwave oven (i.e., the operation of the blower fan when cooking is not processed) can be prevented. In addition, since the second reference value is set as a standard value for determining a low amount of the fumes and/or moisture, a clean interior environment can be maintained by removing the fumes and/or moisture to a predetermined level.

As described above, the microwave oven can more reliably remove the polluted matters generated during the cooking process.

Although the present invention is designed to be more effectively applied to the OTR type microwave oven, it is also possible to apply the present invention to a normal stand-alone type microwave oven, obtaining the identical effect.

As described above, since the apparatus of the present invention can quickly exhaust the polluted air containing the fumes and/or moisture generated during the cooking process, the interior environment can be more improved.

Furthermore, since the sensor is designed to detect the fumes and/or moisture rather than a temperature, the operational reliability of the blower fan can be more improved. That is, the blower fan can be operated timely.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An apparatus in a microwave oven for exhausting pollutant generated during a cooking process, the apparatus comprising:

a sensor part located at a predetermined portion of the microwave oven, for detecting fumes and/or moisture contained in polluted air generated during the cooking process;

a controller for determining an amount of the fumes and/or moisture detected by the sensor part, the controller outputting a driving signal in response to the amount of the fumes and/or moisture exceeding a first predetermined reference value, the controller stopping outputting the driving signal in response to the amount of the fumes and/or moisture equal to or lower than a second predetermined reference value, the first predetermined reference value being higher than the second predetermined reference value; and a fan driving part, the fan driving part in response to the driving signal inhaling the polluted air containing a pollutant and removing the pollutant.

2. The apparatus according to claim 1, wherein the sensor part comprises a detecting sensor installed in an intake duct part of the microwave oven.

3. The apparatus according to claim 1, further comprising an exhaust hole formed at a predetermined portion of the microwave oven, and allowing the air discharged by the fan driving part to be exhausted to an exterior.

4. The apparatus according to claim 1, further comprising:

a discharge duct part allowing the air inhaled by the fan driving part to be discharged into the interior; and a filter disposed in the discharge duct part, for filtering the pollutant contained in the inhaled air.

5. A method of exhausting pollutant through a microwave oven, the method comprising the steps of:

detecting fumes and/or moisture generated during a cooking process;

driving a blower fan when an amount of the detected fumes and/or moisture is higher than a first predetermined reference value; and stopping the blower fan when the amount of the detected fumes and/or moisture is equal to or lower than a second predetermined reference value, the first predetermined reference value being higher than the second predetermined reference value.

6. The method according to claim 5, further comprising the step of maintaining an operation of the blower fan when the amount of the fumes and/or moisture detected after the blower fan is operated is greater than a second reference level.

7. The method according to claim 5, wherein, while the blower fan is operated, the air containing polluted air is exhausted to an exterior.

8. The method according to claim 5, wherein the air inhaled by the blower fan is filtered and is then discharged to an interior.

9. A method of exhausting pollutant through a microwave oven, the method comprising the steps of:

driving a blower fan when an amount of fumes and/or moisture contained in the pollutant generated during a cooking process is higher than a first predetermined reference value;

purifying the pollutant; and stopping the blower fan when the amount of fumes and/or moisture contained in the pollutant detected after the purifying step, is equal to or lower than a second predetermined reference value, the first predetermined reference value being higher than the second predetermined reference value.

10. The method according to claim 9, wherein the purifying step is performed by exhausting the air containing the pollutant to an exterior.

11. The method according to claim 9, wherein the purifying step is performed by purifying the pollutant through a filter and discharging the purified air to an interior.

12. The method according to claim 9, wherein the first predetermined reference value is a reference value for determining an amount of the fumes and/or moisture generated at an initial cooking stage.

13. The method according to claim 9, wherein the second predetermined reference value is a reference value for determining a purification degree of an interior environment when the pollutant is exhausted out of the interior by some degree.

14. The method according to claim 9, wherein the first predetermined reference value represents a higher pollution degree than the second predetermined reference value.

15. An apparatus in a microwave oven for exhausting pollutant generated during a cooking process, the apparatus comprising:

a detecting sensor located at a predetermined position of the microwave oven, for detecting an amount of fumes and/or moisture of an air;

a blower fan, the blower fan inhaling the air when the amount of the fumes and/or moisture is higher than a first predetermined reference value, the blower fan stopping inhaling the air when the amount of the fumes and/or moisture is equal to or lower than a second predetermined reference value, the first predetermined reference value being higher than the second predetermined reference value;

an exhaust holes, through which the air inhaled by the blower fan is dischargeable to an exterior through the exhaust hole; and a discharge duct part, through which the air inhaled by the blower fan is dischargeable to an interior through the discharge duct part.

16. The apparatus according to claim 15, wherein the microwave oven is an over-the-range type.

17. The apparatus according to claim 15, wherein the discharge duct part comprises a filter for filtering the pollutant.

* * * * *